US007654297B2

(12) United States Patent
Wu

(10) Patent No.: US 7,654,297 B2
(45) Date of Patent: Feb. 2, 2010

(54) CORRECTION TAPE DISPENSER

(75) Inventor: Cheng-Loung Wu, Chang Hua (TW)

(73) Assignee: SDI Corporation (TW)

( * ) Notice: Subject to any disclaimer, the term of this patent is extended or adjusted under 35 U.S.C. 154(b) by 619 days.

(21) Appl. No.: 11/657,353

(22) Filed: Jan. 24, 2007

(65) Prior Publication Data

US 2008/0173406 A1 Jul. 24, 2008

(51) Int. Cl.
*B32B 37/26* (2006.01)
*B26F 3/02* (2006.01)
*B43L 19/00* (2006.01)

(52) U.S. Cl. ..... 156/577; 156/523; 156/527; 156/579; 118/76; 118/200; 118/257; 242/588; 242/588.3; 242/588.6; 242/160.2; 242/160.4; 206/411

(58) Field of Classification Search ..... 156/523, 156/527, 538, 540, 547, 577, 579; 118/76, 118/200, 257; 225/46; 242/160.2, 160.4, 242/170, 171, 588, 588.2, 588.3, 588.6; 206/411
See application file for complete search history.

(56) References Cited

U.S. PATENT DOCUMENTS 5,346,580 A * 9/1994 Elges et al. ..... 156/540
6,171,397 B1 * 1/2001 Mitsuya ..... 118/257
D475,747 S * 6/2003 Ono ..... D19/69
6,730,186 B2 * 5/2004 Takahashi ..... 156/238
D544,544 S * 6/2007 Wu ..... D19/69
D547,804 S * 7/2007 Wu ..... D19/69
2009/0159217 A1 * 6/2009 Sun ..... 156/540
2009/0185848 A1 * 7/2009 Ushijima ..... 400/697
2009/0229763 A1 * 9/2009 Lin ..... 156/577

* cited by examiner

*Primary Examiner*—Mark A Osele
(74) *Attorney, Agent, or Firm*—Jackson Walker, LLP

(57) ABSTRACT

A correction tape dispenser has a front cover, a core assembly, an extending-and-retracting mechanism and a rear cover. The core assembly is mounted slidably in the front cover and has a convex portion extending out of the front cover. The extending-and-retracting mechanism selectively drives the core assembly to hold forward or backward. The rear cover is mounted on the front cover. A user pushes the core assembly with the extending-and-retracting mechanism forward to extend the head out of or retract the head into the front cover. Retracting the head prevents dust from accumulating on a correction tape on the head.

12 Claims, 13 Drawing Sheets

CORRECTION TAPE DISPENSER

BACKGROUND OF THE INVENTION

1. Field of the Invention

The present invention relates to a tape dispenser, and more particularly to a correction tape dispenser that has a front cover and a head wounded by a correction tape and mounted retractably in the front cover. Using the correction tape dispenser is easy and convenient.

2. Description of Related Art

A conventional tape dispenser has a casing, a cover and a tape-output assembly. The tape-output assembly is mounted in the casing and has a reel of a correction tape and a head. The head is wound by the reel of the correction tape and extends out from the casing to stick a section a coating film of the correction tape to a paper sheet as the head presses against the paper sheet. The cover is mounted detachably on the casing and covers the head to keep dust from being accumulated on the coating film of the correction tape on the head. However, the cover is missed easily to expose the head and the correction tape in the air so dust is accumulated on the coating film and causes the coating film to adhere hardly to a paper sheet.

An improved correction tape dispenser has a casing, a reel of a correction tape, a head and a press button. The head is mounted retractably on the casing. The press button is mounted on the casing and connects to the head so pushing the pushing button extends out the head from the casing. However, a user holding the correction tape dispenser with one hand cannot easily push the button.

To overcome the shortcomings, the present invention provides a correction tape dispenser to mitigate or obviate the aforementioned problems.

SUMMARY OF THE INVENTION

The main objective of the invention is to provide a correction tape dispenser that has a front cover and a head wounded by a correction tape and mounted retractably in the front cover. Using the correction tape dispenser is easy and convenient.

A correction tape dispenser in accordance with the present invention comprises a front cover, a core assembly, an extending-and-retracting mechanism and a rear cover. The core assembly is mounted slidably in the front cover and has convex portion extending out of the front cover. The extending-and-retracting mechanism selectively drives the core assembly to hold forward or backward. The rear cover is mounted on the front cover.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
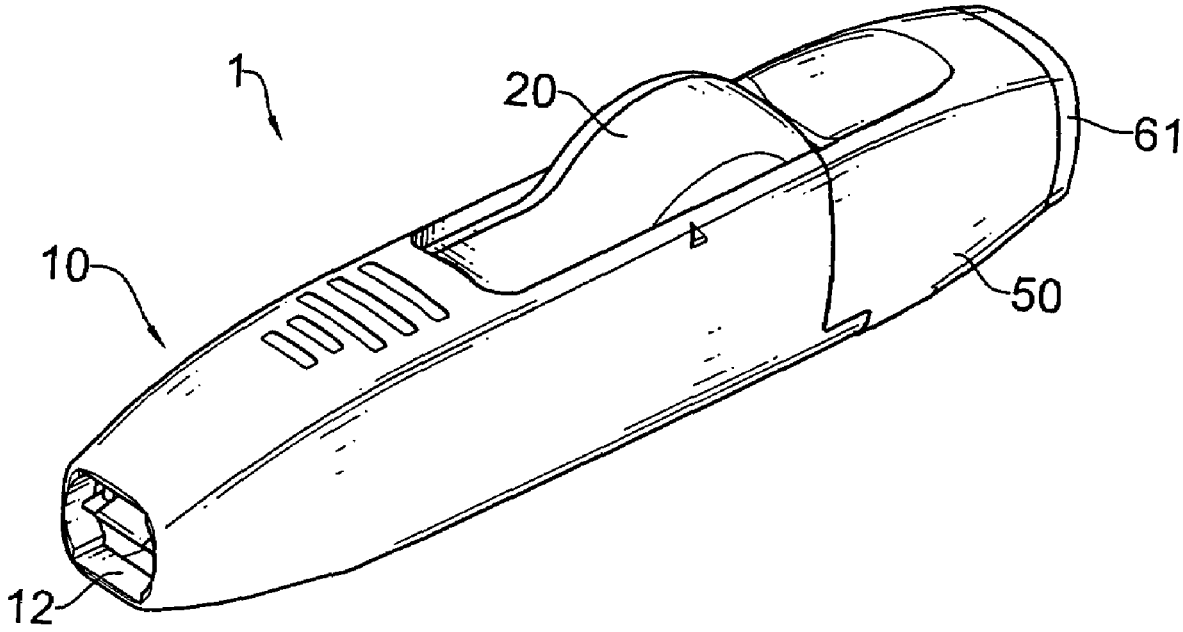
FIG. 1 is a perspective view of a first embodiment of a correction tape dispenser in accordance with the present invention.
Figure 2:
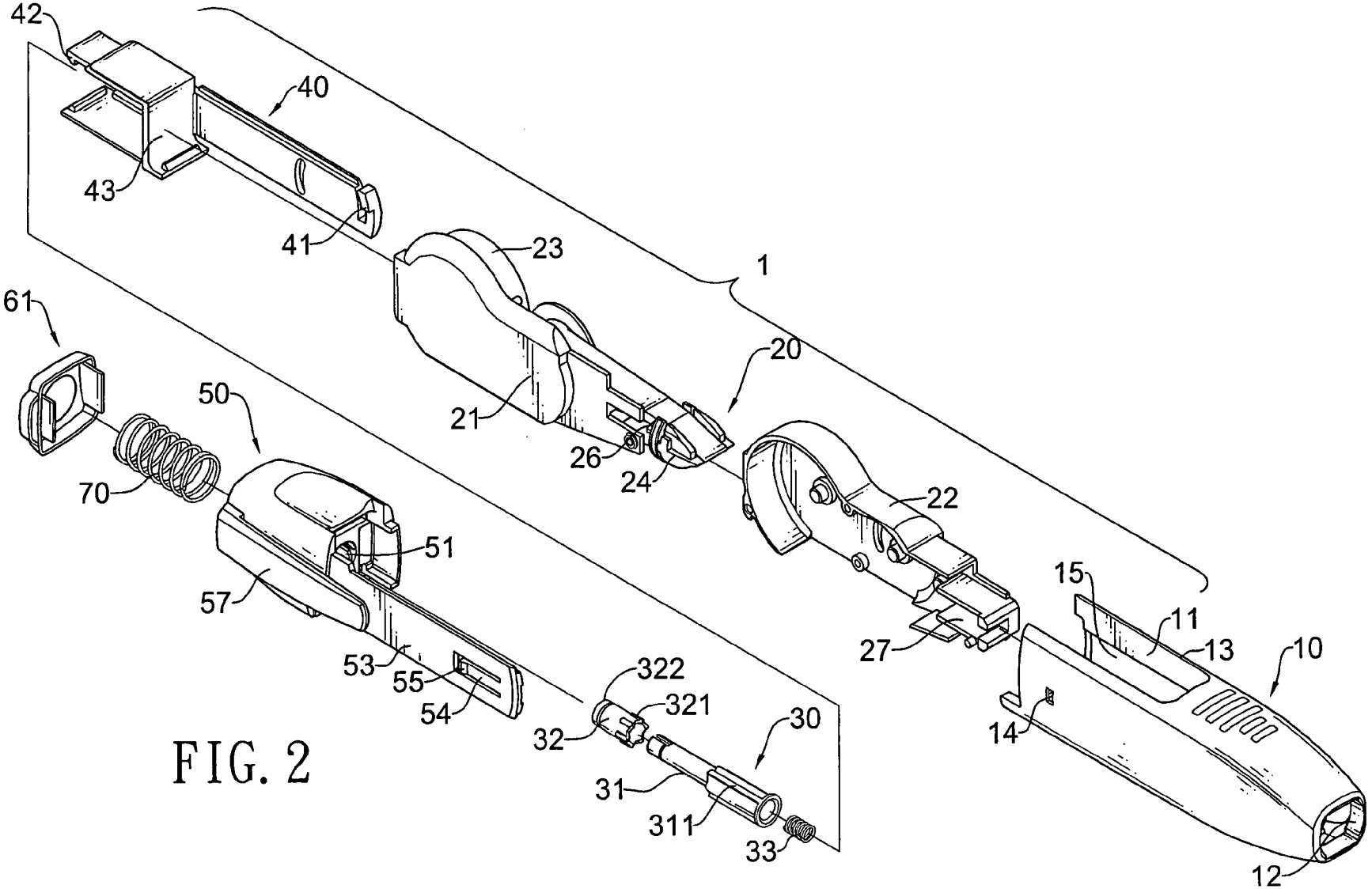
FIG. 2 is an exploded perspective view of the correction tape dispenser in FIG. 1.
Figure 3A:
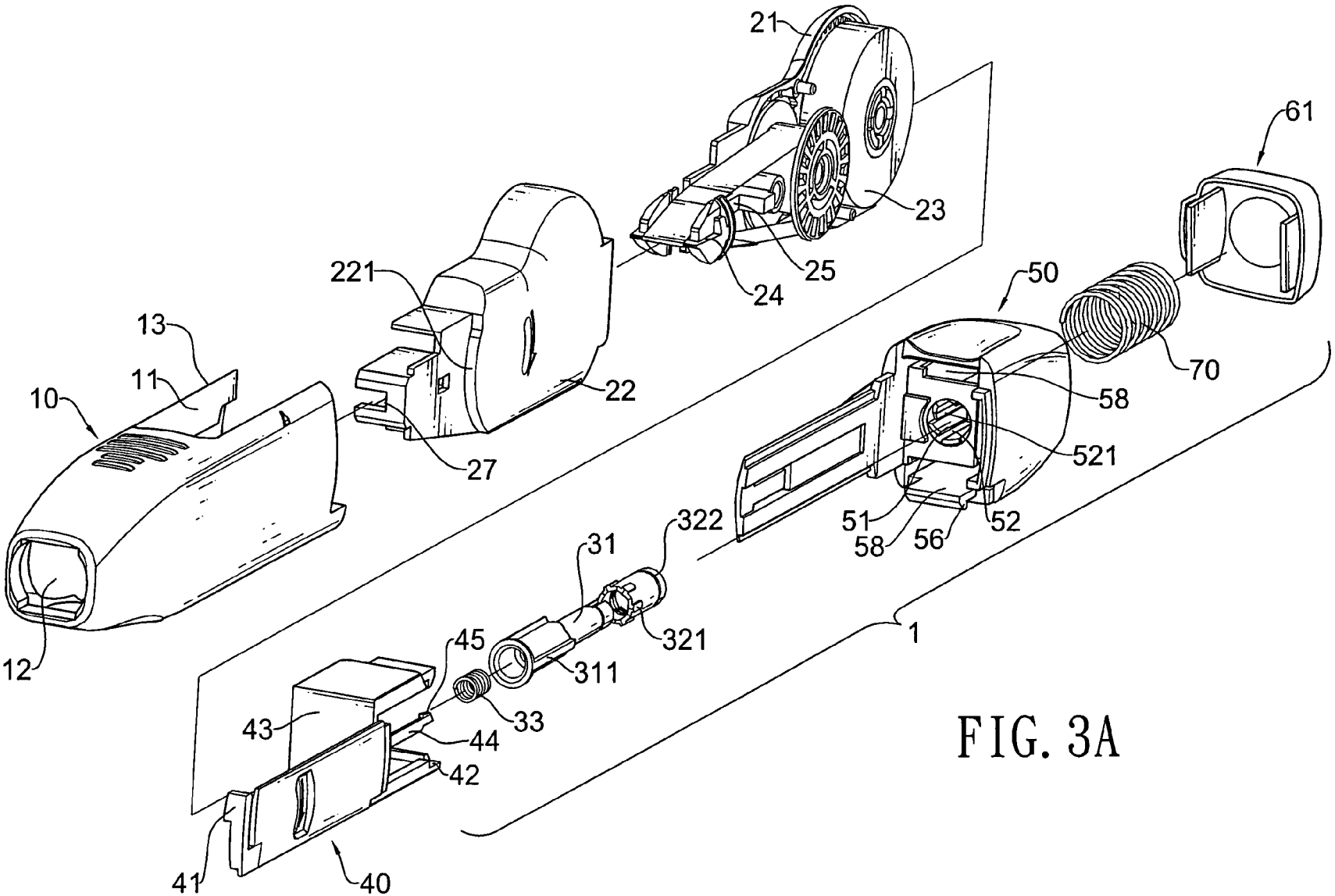
FIG. 3A is another exploded perspective view of the correction tape dispenser in FIG. 1.
Figure 3B:
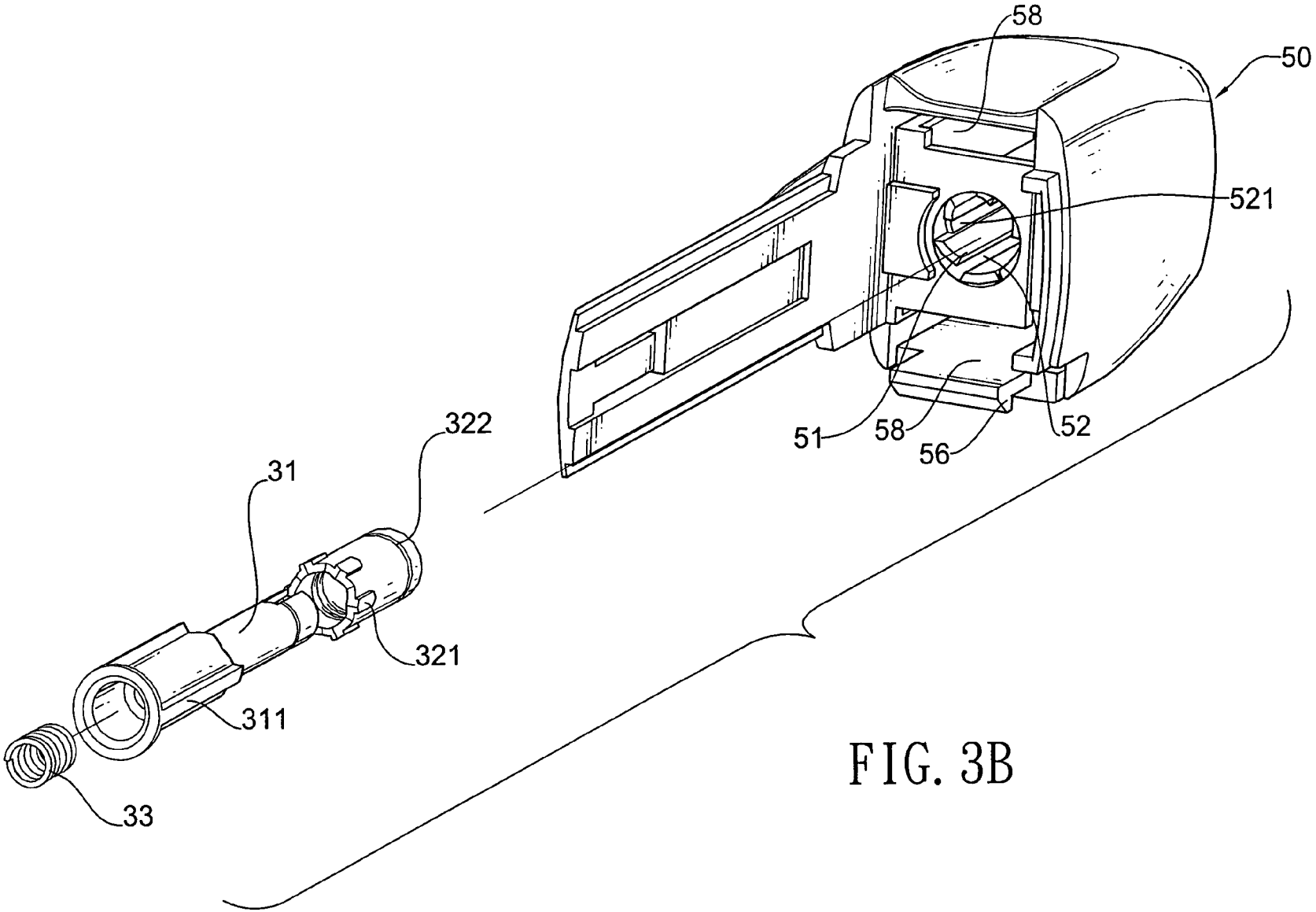
FIG. 3B is an exploded and enlarged perspective view of the extending-and-retracting mechanism and the rear cover of the correction tape dispenser in FIG. 3A.

With reference to FIGS. 1 to 6, a first embodiment of a correction tape dispenser (1) in accordance the present invention comprises a front cover (10), a core assembly (20), a slide bracket (40), an extending-and-retracting mechanism (30), a rear cover (50), a rear cap (61) and a spring (70).

The front cover (10) is longitudinal and has a top, a bottom, two sides, a front end, a rear end, a cavity (11), a front opening (12), an open slot (13), a locking slot (16), two rail recesses (15) and a locking hole (14). The cavity (11) is defined in the cover (10) and has an inner surface. The front opening (12) is defined through the front end, communicates with the cavity (11) and has a flat upper inner surface, a flat lower inner surface and two curved side inner surfaces. The open slot (13) is defined in the rear end through the top and communicates with the cavity (11). The locking slot (16) is defined through the bottom. The rail recesses (15) are defined in the inner surface of the cavity (12) respectively on the sides. The locking hole (14) is defined through one of the sides.

Figure 4A:
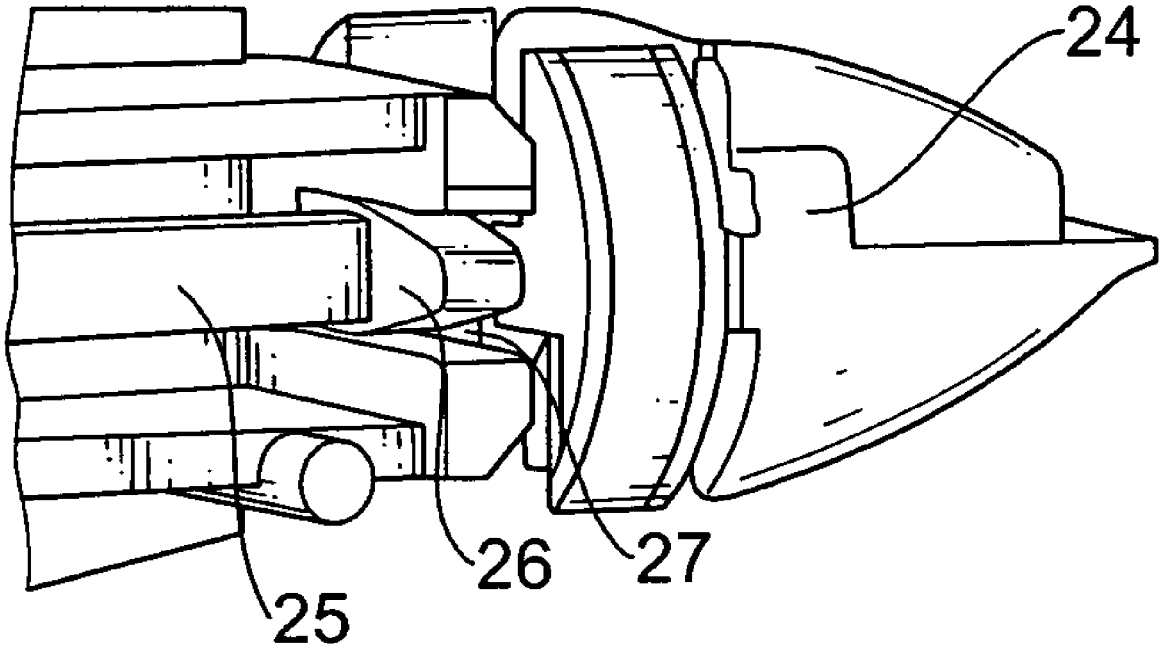
FIG. 4A is an enlarged perspective view of the core assembly of the correction tape dispenser in FIG. 2.
Figure 4B:
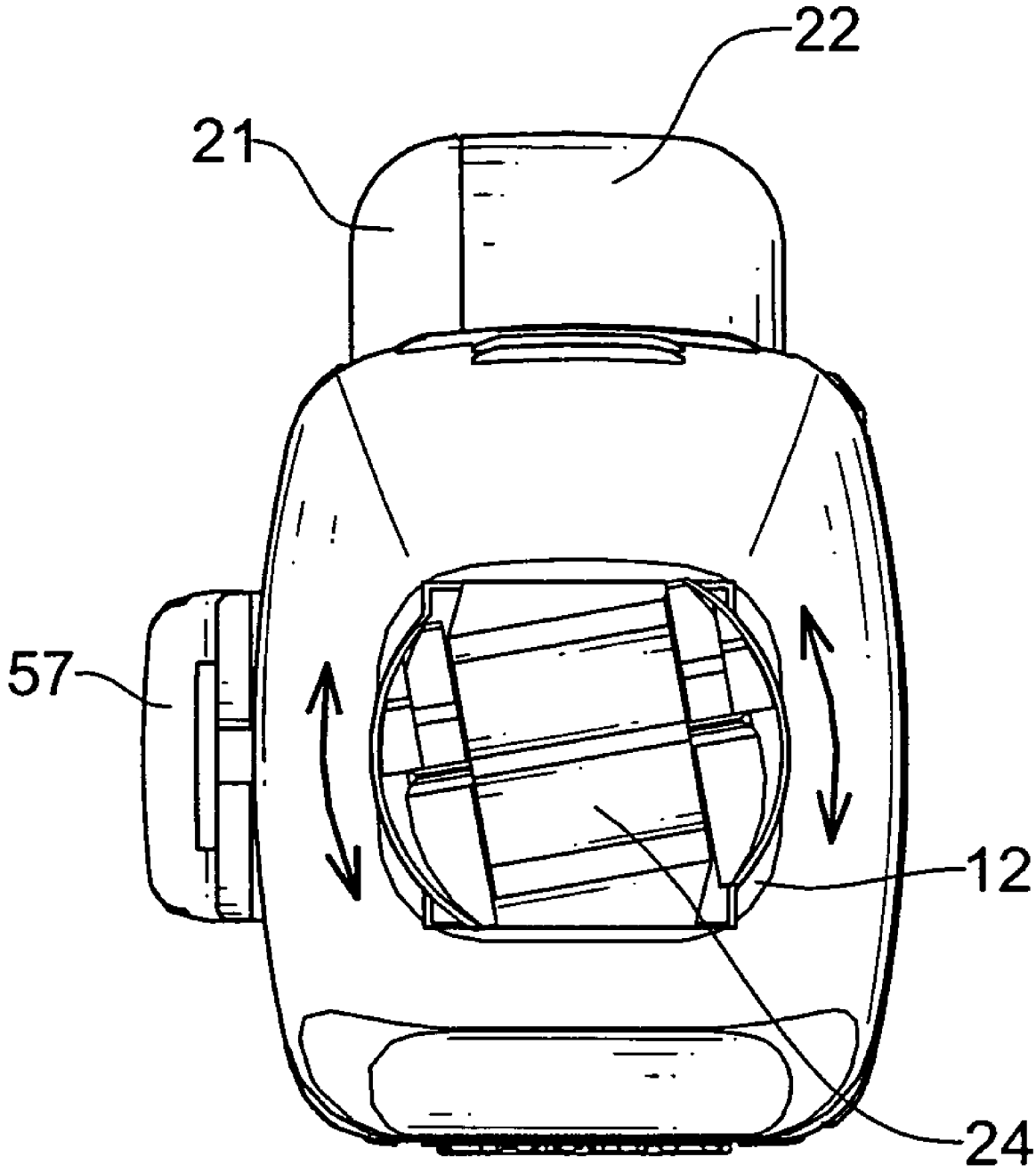
FIG. 4B is an operational front view of the head of the core assembly of the correction tape dispenser in FIG. 4A rotating.

The core assembly (20) is replaceable. When a correction tape on the core assembly (20) is entirely consumed, the core assembly (20) is replaced with a new one. The core assembly (20) extends in the rear end of the front cover (10) and is mounted detachably in the cavity (11) and has a top, a front end, a convex portion, a chassis (21) and a shell (22), a core (23), a connector (25) and a head (24). The convex portion protrudes from the top of the core assembly (20) and slidably extends through the open slot (13) in the front cover (10). The chassis (21) extends in the rear end of the front cover (10), is mounted detachably in the cavity (11) and has a top, a front end, a rear end and a convex segment formed on the top. The shell (22) is mounted on the chassis (21) and has a top, a front end, a rear end, a convex segment, a shoulder (221) and a mounting recess (27). The convex segment is formed on the top of the shell (22) and combines the convex segment on the chassis (21) to define the convex portion. The shoulder (221)

is formed on the shell (22) and faces forward. The mounting recess (27) is defined in the front end of the core assembly (20), is defined in the front end of the shell (22) and has an inner surface. The core (23) is mounted on the chassis (21), is covered by the shell (22) and has a reel of a correction tape. The reel of the correction tape has a coating film that may adhere to a paper sheet. The connector (25) is resilient and capable of twisting, is mounted on the chassis (21) in front of the core (23), is mounted in the mounting recess (27) in the shell (22) and has a front end and a limit (26). The limit (26) is formed on and extends transversely from the connector (25) in the mounting recess (27), is tapered outward and selectively presses against the inner surface of the mounting recess (27) to limit an extent to which the connector (25) twists. The head (24) is mounted on the front end of the connector (25), is capable of rotating due to the twist of the connector (25) and is wound by the correction tape, as shown in FIGS. 4A and 4B. The head (24) may press against a paper sheet to stick a section of the coating film of the correction tape to the paper sheet.

The slide bracket (40) is mounted slidably through the rear end in one of the rail recesses (15) in the cavity (11) in the front cover (10) and is mounted on and moves with the core assembly (20). The slide bracket (40) has a front end, a rear end, a front hook (41), a pair of rear hooks (42), an abutment board (43), an extension tab (44) and a clasp (45). The front hook (41) is formed on the front end of the slide bracket (40) and hooks on the shoulder (221) on the shell (22) of the core assembly (20). The rear hooks (42) are formed on the rear end of the slide bracket (40). The abutment board (43) is formed on the slide bracket (40) and abuts the rear end of the shell (22) of the core assembly (20). The extension tab (44) is formed on and extends backward from the abutment board (43) of the slide bracket (40). The clasp (45) is formed on the extension tab (44).

The extending-and-retracting mechanism (30) is mounted on the slide bracket (40), selectively drives the core assembly to hold forward or backward and has a shaft (31), a cylinder (32) and a bias element. The shaft (31) is hollow and tubular, is mounted slidably and rotatably around the extension tab (44) on the slide bracket (40) and has a front end, a rear end, an annular flange and multiple ridges (311). The annular flange is formed on and extends radially from the shaft (31) adjacent to the front end of the shaft (31) and has a rear end and multiple keys. The keys extend backward from the rear end of the annular flange and are divided into two sets of alternate keys. The ridges (311) are formed on and extend radially from the annular flange on the shaft (31), correspond respectively to the alternate keys of one set and each ridges (311) has a rear end with an inclined surface. The cylinder (32) is hollow and tubular, is mounted slidably and rotatably around the shaft (31), abuts the annular flange, is hooked and held by the clasp (45) on the extension tab (44) and has a front end, a rear end (322), multiple keyways and multiple alignment projections (321). The rear end (322) of the cylinder (32) is hooked and held by the clasp (45) to prevent the extending-and-retracting mechanism (30) from falling out of the slide bracket (40). The keyways are defined in the front end of the cylinder (32) and selectively engage respectively with the keys on the shaft (31). The alignment projections (321) are formed on and extend radially from the cylinder (32) and are arranged respectively between adjacent keyways. The bias element may be a spring (33), is mounted around the extension tab (44) and is mounted between the abutment board (43) on the slide bracket (40) and the front end of the shaft (31).

Figure 5:
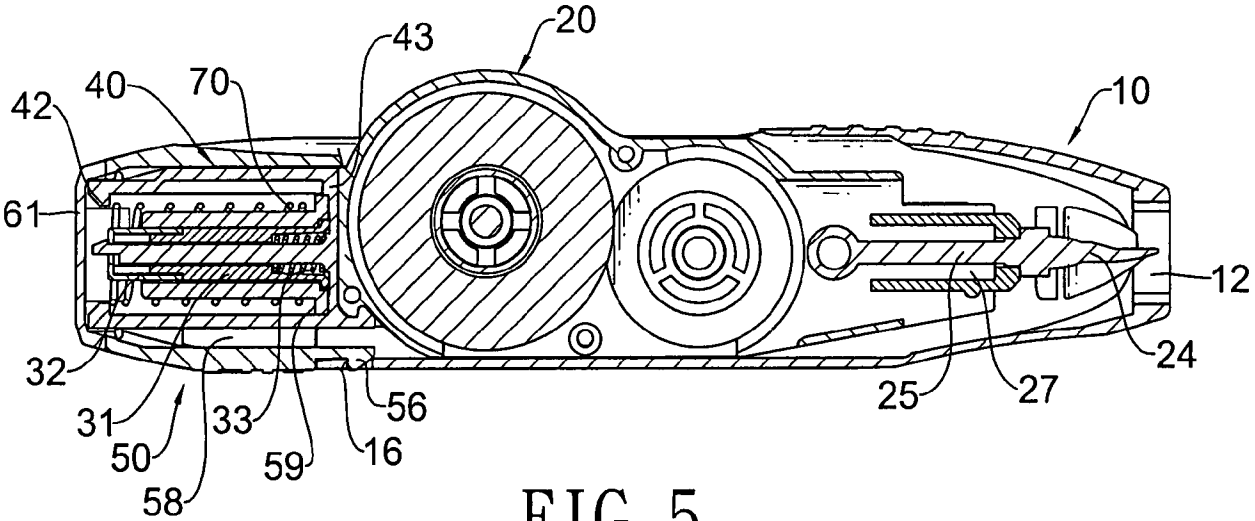
FIG. 5 is a cross sectional side view of the correction tape dispenser in FIG. 1.
Figure 6:
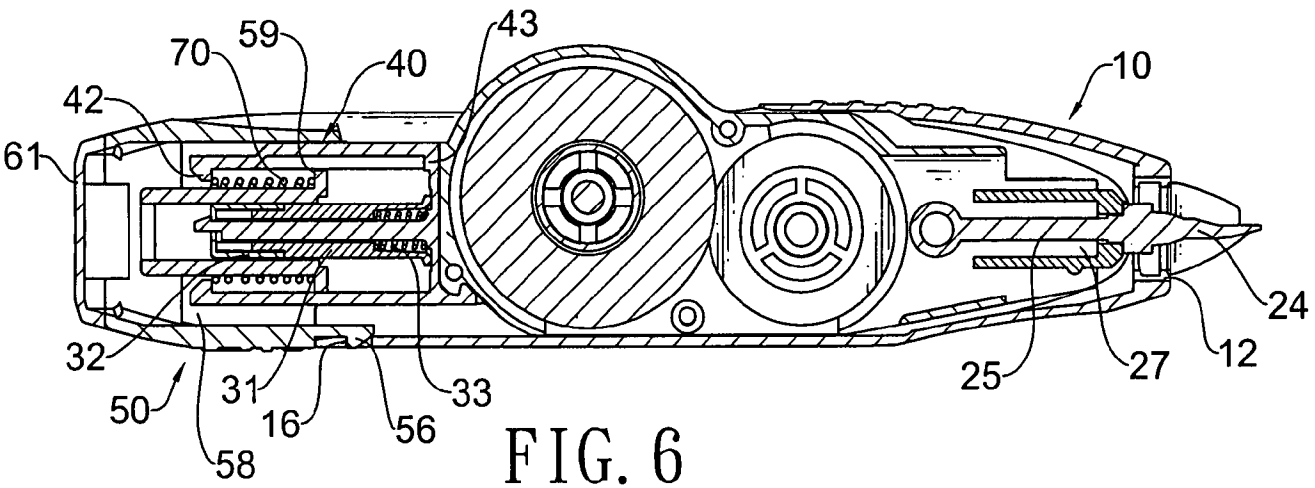
FIG. 6 is an operational cross sectional side view of the correction tape dispenser in FIG. 5 with the head extending out.
Figure 7:
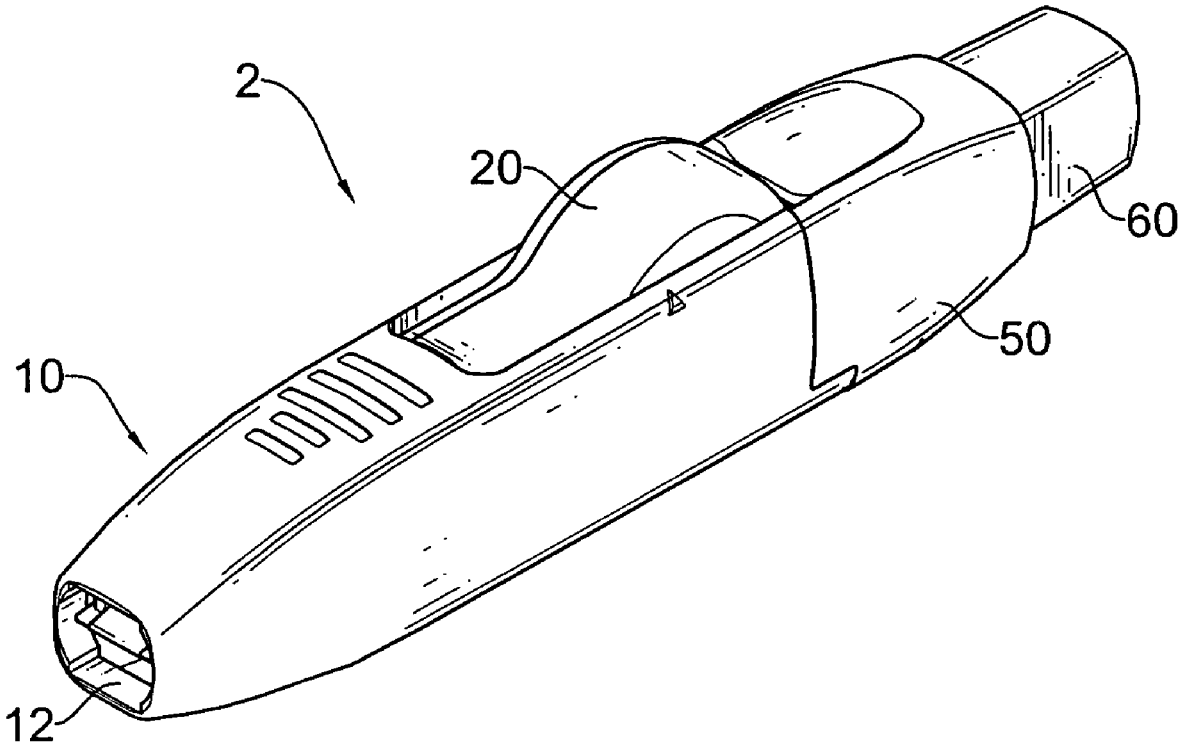
FIG. 7 is a perspective view of a second embodiment of the correction tape dispenser in accordance with the present invention.

The rear cover (50) is longitudinal, is mounted on the front cover (10) and has a front end, a rear end, a chamber, a bottom locking hook (56), a pair of slide slots (58), a mounting hole, multiple ribs (51), multiple grooves (52), a strip (53) and a clip (57). The chamber is defined in the rear cover (50) and has a front inside wall (59), as shown in FIG. 5. The bottom locking hook (56) is formed on the front end of the rear cover (50) and hooks in the locking slot (16) in the bottom of the front cover (10). The slide slots (58) are defined in the front end of the rear cover (50), communicate with the chamber and slidably receive the rear hooks (42) on the slide bracket (40) respectively. The mounting hole is defined longitudinally in the rear cover (50), slidably receives the cylinder (32) and the shaft (31) and has an inner surface. The ribs (51) are formed on and extend radially inward from the inner surface of the mounting hole and each rib (51) has a front end with an inclined surface corresponding to inclined surface on each of the ridges (311) on the shaft (31). The grooves (52) are defined in the inner surface of the mounting hole respectively between adjacent ribs (51) and slidably receive the alignment projections (321) on the cylinder (32) respectively so the cylinder (32) cannot rotate in the mounting hole. The grooves (52) are divided into two sets of alternate grooves (52). Each of the alternate grooves (52) of one set has a block (521) formed in the groove (52). When the alternate grooves (52) with the blocks (521) engage respectively with the ridges (311) on the shaft (31), the blocks (521) press respectively against the ridges (311) to hold the slide bracket (40) and the core assembly (20) at a forward position relative to the front cover (10) to extend the head (24) of the core assembly (20) out of the front cover (10), as shown in FIG. 6. When the alternate grooves (52) without the blocks (521) engage respectively with the ridges (311), the head retracts backward into the front cover (10). The strip (53) is formed on and extends forward from the front end of the rear cover (50), is mounted slidably in one of the rail recesses (15) in the front cover (10) and has a recoiling tab (54) and a side locking hook (55). The recoiling tab (54) is formed on the strip (53) and has a distal end. The side locking hook (55) is formed on the distal end and hooks in the locking hole (14) on the front cover (10). The clip (57) is formed on the rear cover (50) and may clip on a chest pocket on a shirt.

The rear cap (61) is mounted on the rear end of the rear cover (50).

The spring (70) is mounted in the chamber in the rear cover (50) between the front inside wall (59) and the rear hooks (42) on the slide bracket (40) and is hooked by the rear hooks (42).

With reference to FIGS. 5 and 6, a user pushes convex portion on the core assembly (20) forward and compresses the spring (70) between the rear hooks (42) of the slide bracket (40) and inside wall (59) of the rear cover (50) to extend the head (24) out through the front opening (12) in the front cover (10). The slide bracket (40) is driven by the core assembly (20) to move forward and the ridges (311) on the shaft (31) moves forward out of the alternate grooves (52) without the blocks (521) in the mounting hole. At the same time, the keys on the shaft (31) completely engage respectively with the keyways in the cylinder (32) to cause the shaft (31) to rotate slightly so the ridges (311) are aligned respectively with alternate ribs (51). When the user releases the core assembly (20), the core assembly (20) slightly moves backward due to the restoring force of the spring (70) between the slide bracket (40) and the rear cover (50). At the same time, the inclined surfaces of the ridges (311) on the shaft (31) slide respectively along the inclined surfaces of the ribs (51) in the rear cover (50) to further rotate the shaft (31). Then the ridges (311) on the shaft (31) engage respectively with the alternate grooves (52) with the blocks (521), are blocked respectively by the blocks (521) and are incapable of entirely sliding respectively into the alternate grooves (52). Therefore, the core assembly (20) and the slide bracket (40) cannot move backward and the head (24) is still held outside the front cover (10). When the user pushes the core assembly (20) forward and then releases the core assembly (20) again, the ridges (311) entirely extend respectively into the alternate grooves (52) without the blocks (521) due to the restoring force of the spring (70) between the slide bracket (40) and the rear cover (50). The slide bracket (40) and the core assembly (20) slide backward to retract the head (24) into the front cover (10). Retracting the head (24) in the front cover (10) prevents dust from being attached the correction tape on the head (24).

With reference to FIGS. 7-11, a second embodiment of the correction tape dispenser (2) in accordance with the present invention further has a press button (60) to push the slide bracket (40) and the core assembly (20) forward. Features in the second and first embodiments with same reference numbers are identical and function in the same manner.

Figure 8:
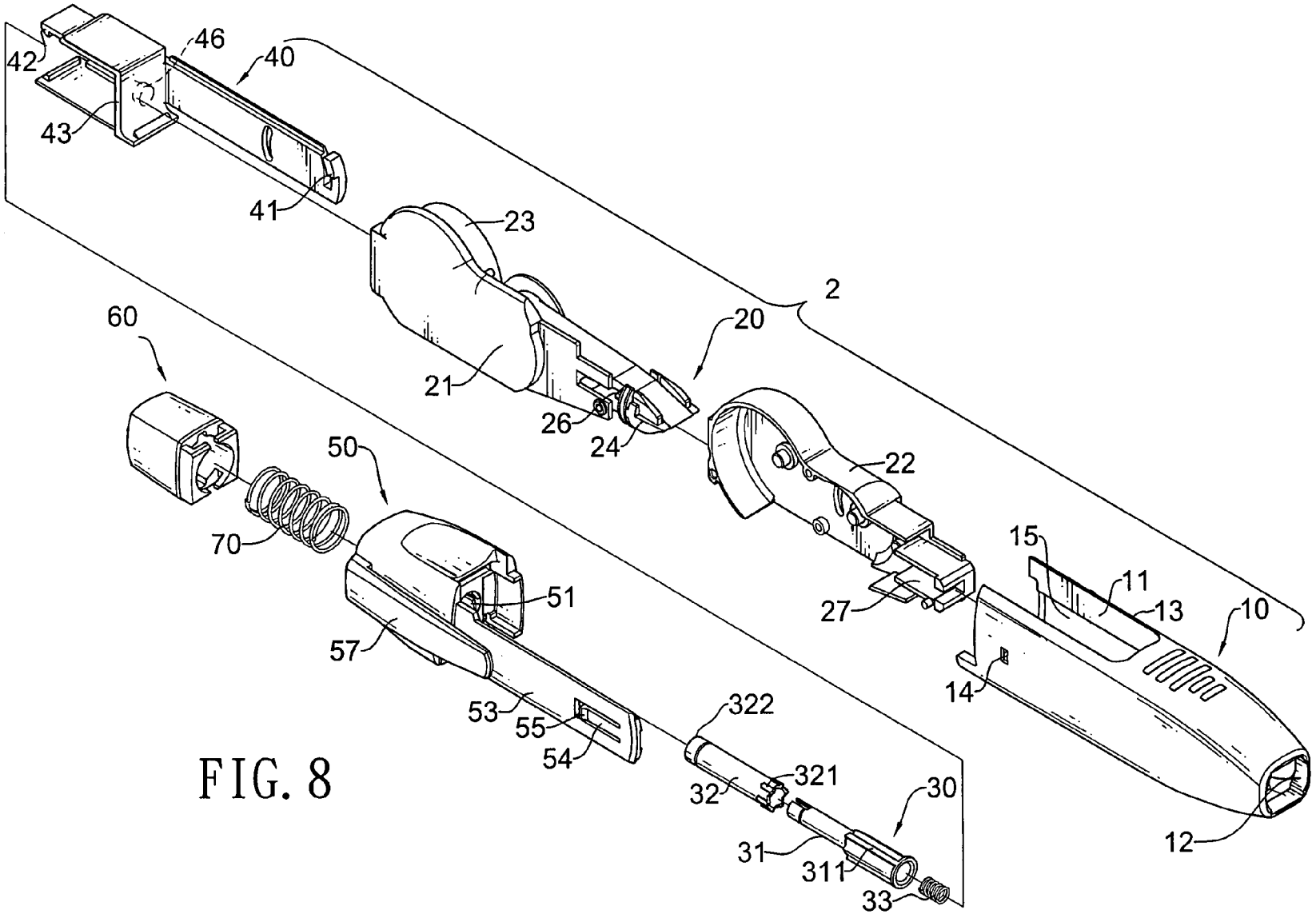
FIG. 8 is an exploded perspective view of the correction tape dispenser in FIG. 7.
Figure 9:
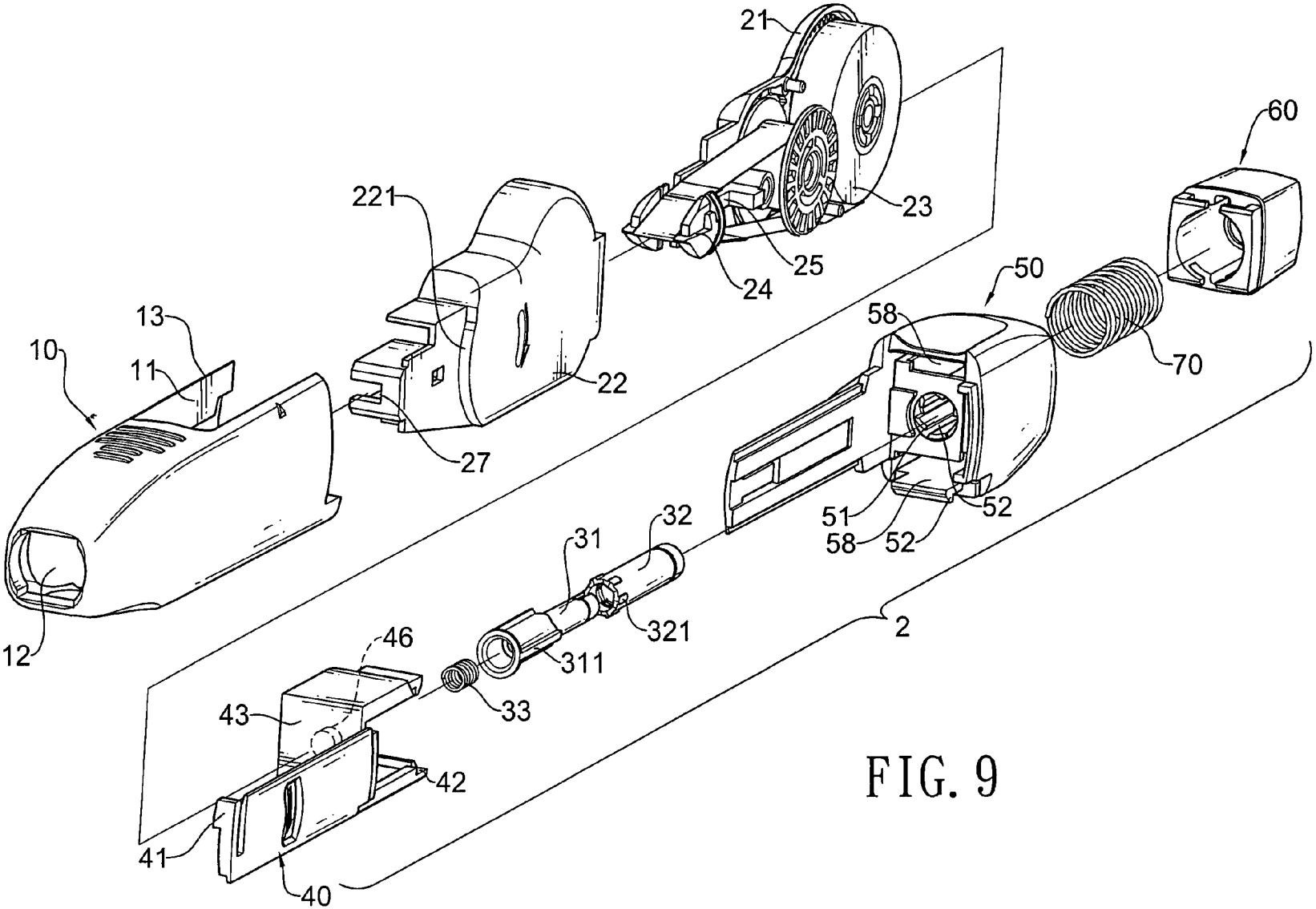
FIG. 9 is another exploded perspective view of the correction tape dispenser in FIG. 7.
Figure 10:
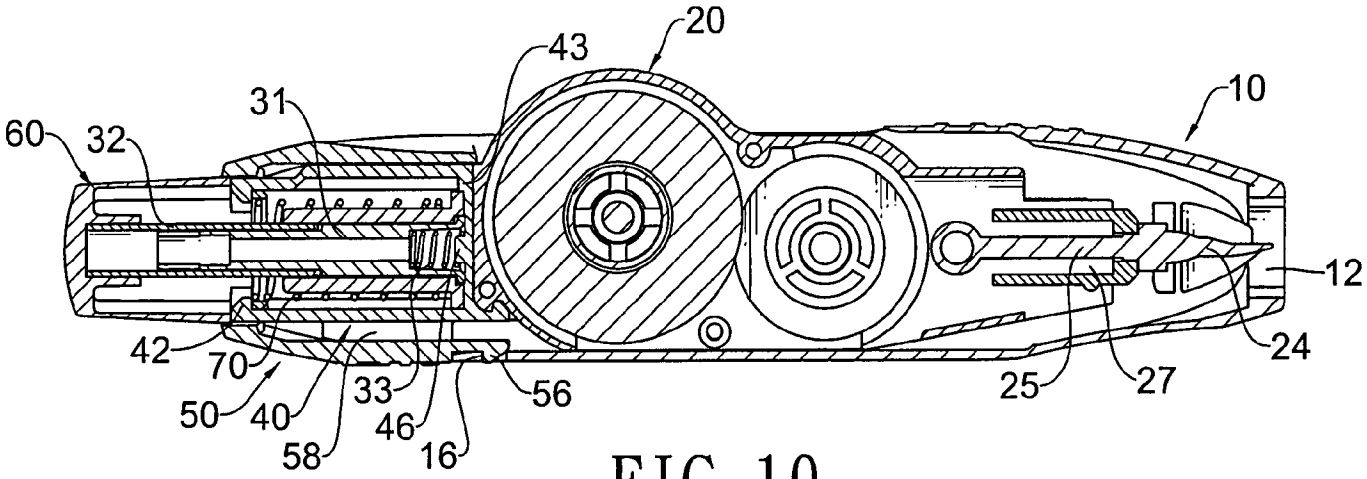
FIG. 10 is a cross sectional side view of the correction tape dispenser in FIG. 7.

With reference to FIG. 8, the abutment board (43) of the slide bracket (40) further has a protrusion (46) formed on and extending backward from the abutment board (43) and mounted in the bias element to prevent the extending-and-retracting mechanism (30) from falling off. The rear end of the rear cover (50) has a rear opening defined through the rear end and communicating with the chamber. The press button (60) is mounted slidably through the rear opening in the chamber, is hooked by the rear hooks (42) on the slide bracket (40) and abuts the rear end (322) of the cylinder (32). When the user presses the rear hooks (42) on the slide bracket (40) to push the slide bracket (40), the spring (70) the between the rear cover (50) and the press button (60) is compressed. The cylinder (32), the shaft (31) and the core assembly (20) are driven by the slide bracket (40) to move forward. The ridges (311) on the shaft (31) move forward out of the alternate grooves (52) with the blocks (521) in the mounting hole. At the same time, the keys on the shaft (31) completely engage respectively with the keyways in the cylinders (32) to cause the shaft (31) to rotate slightly so the ridges (311) are aligned respectively with alternate ribs (51). When the user releases the press button (60), the core assembly (20) slightly moves backward due to the restoring force of the spring (70) between the slide bracket (40) and the rear cover (50). At the same time, the inclined surfaces of the ridges (311) on the shaft (31) slide respectively along the inclined surfaces of the ribs (51) in the rear cover (50) to further rotate the shaft (31). Then the ridges (311) on the shaft (31) engage respectively with the other alternate grooves (52) with the blocks (521), are blocked respectively by the blocks (521) and are incapable of entirely sliding respectively into the alternate grooves (52). Therefore, the core assembly (20) and the slide bracket (40) cannot move backward and the head (24) is still held outside the front cover (10). When the user pushes the core assembly (20) forward and then releases the core assembly (20) again, the ridges (311) entirely extend respectively into the alternate grooves (52) without the blocks (521) due to the restoring force of the spring (70) between the slide bracket (40) and the rear cover (50). The slide bracket (40) and the core assembly (20) slide backward to retract the head (24) into the front cover (10).

Figure 12:
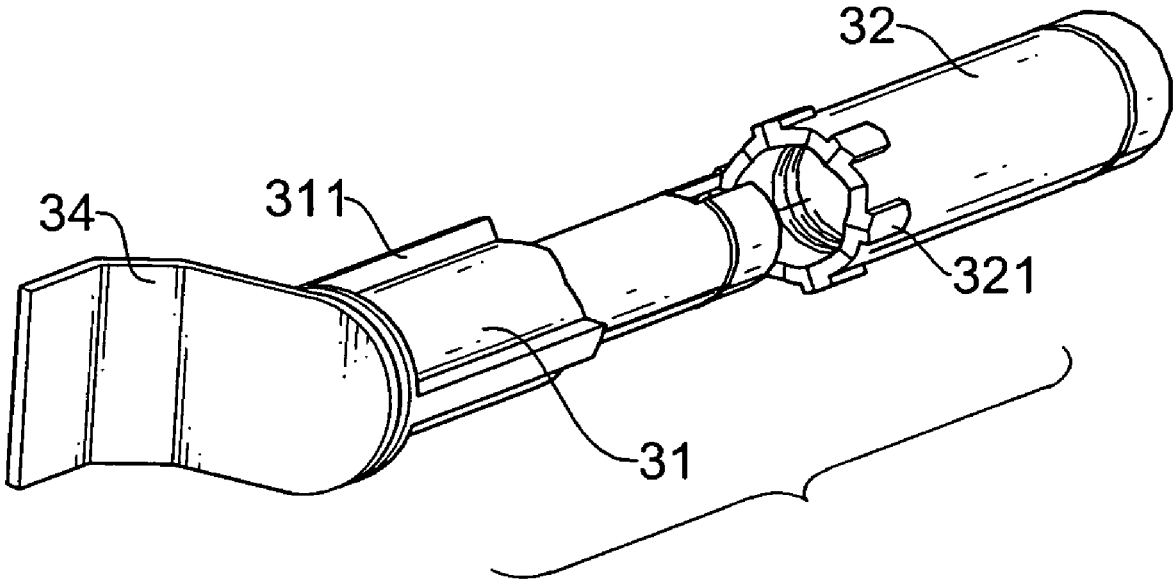
FIG. 12 is a perspective view of the extending-and-retracting mechanism of a third embodiment of the correction tape dispenser in accordance with the present invention.
Figure 13:
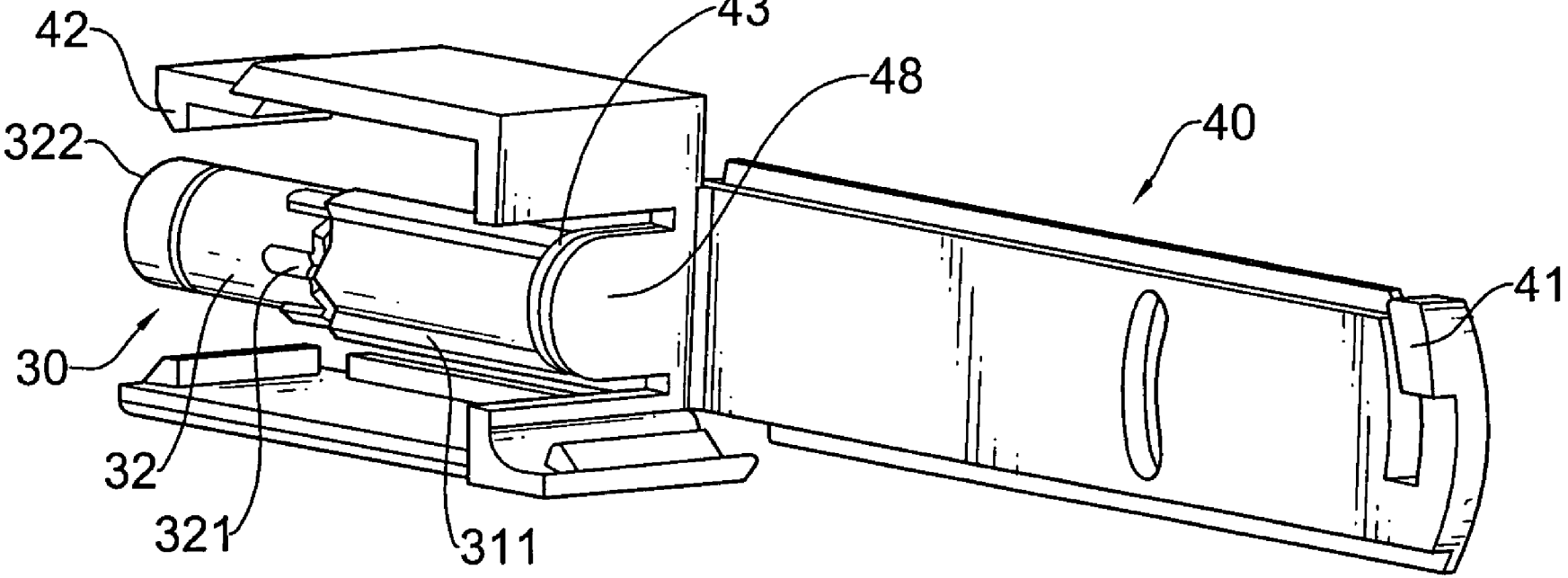
FIG. 13 is a perspective view of the slide bracket and the extending-and-retracting mechanism of a fourth embodiment of the correction tape dispenser in accordance with the present invention.

With reference to FIG. 12, a third embodiment of the correction tape dispenser in accordance with the present invention has the bias element being a recoiling tab (34) mounted to the front end of the shaft (31) and having a front end pressing against the abutment board (43) of the slide bracket (40). The restoring force of the recoiling tab (34) moves the shaft (31) backward.

Figure 11:
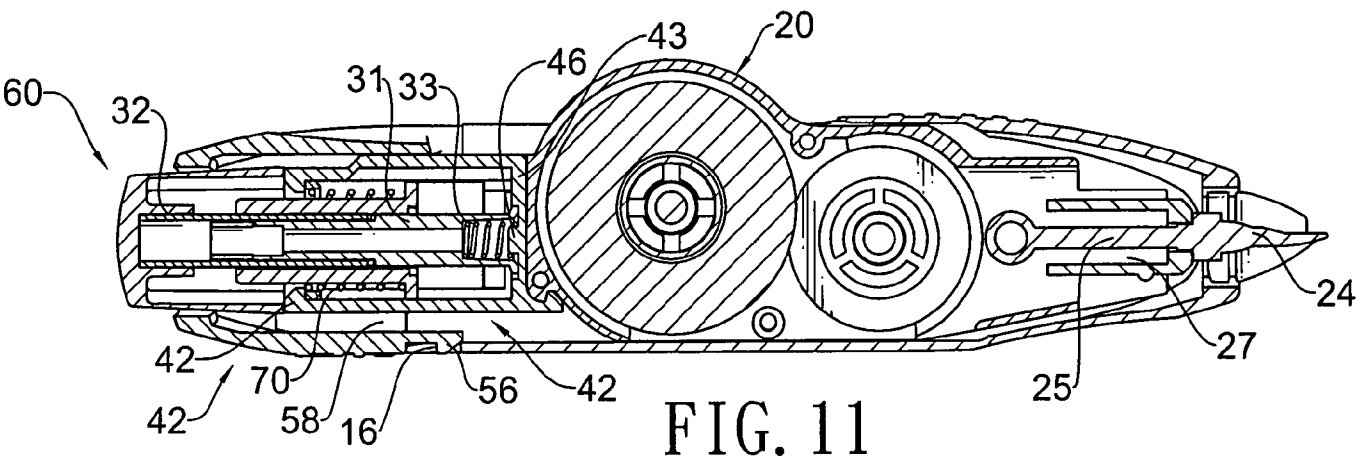
FIG. 11 is an operational cross sectional side view of the correction tape dispenser in FIG. 10 with the head extending out.

With reference to FIG. 11, a fourth embodiment of the correction tape dispenser in accordance with the present invention has the bias element being a recoiling segment (48) formed on the abutment board (43) and pressing against the front end of the shaft (31). The restoring force of the recoiling segment (48) moves the shaft (31) backward.

A user may easily press the press button (60) or push the convex portion of the core assembly (20) to extend the head (24) out of the front cover (10). When the user presses the press button (60) or pushes the convex portion again, the head (24) retracts into the front cover to prevent dust from accumulating on the correction tape on the head. Therefore, using the correction tape dispenser is convenient and efficient.

What is claimed is:

1. A correction tape dispenser comprising:

a front cover being longitudinal and having a top, a bottom, two sides, a front end, a rear end, a cavity defined in the front cover, a front opening communicating with the cavity and an open slot defined in the rear end through the top and communicating with the cavity;

a core assembly mounted in the cavity and having a top, a front end, a convex portion protruding from the top of the core assembly and slidably extending through the open slot in the front cover, a core and a head;

a slide bracket mounted slidably in the cavity and mounted on and moving with the core assembly;

an extending-and-retracting mechanism mounted on the slide bracket and having a shaft having a front end, a rear end and multiple ridges formed on and extending radially from the shaft adjacent to the front end of the shaft, a cylinder being hollow and tubular and mounted slidably and rotatably around the shaft, and a bias element mounted between the slide bracket and the front end of the shaft;

a rear cover being longitudinal, mounted on the front cover and having a front end, a rear end, a chamber defined in the rear cover and having a front inside wall, a mounting hole defined in the rear cover, slidably receiving the cylinder and the shaft and having an inner surface, multiple ribs formed on and extending radially inward from the inner surface of the mounting hole and multiple grooves defined in the inner surface of the mounting hole respectively between adjacent ribs, divided into two sets of alternate grooves, each of the alternate grooves of one set having a block formed in the groove, the alternate grooves with the blocks engaging respectively with the ridges on the shaft as the head of the core assembly extends out of the front cover, and the alternate grooves without the blocks engaging respectively with the ridges as the head retracts backward into the front cover; and a spring mounted in the chamber in the rear cover between the front inside wall and the slide bracket.

2. The correction tape dispenser as claimed in claim 1, wherein:

the slide bracket further has a front end, a rear end, a pairs of rear hooks formed on the rear end of the slide bracket and hooking on the spring, and an abutment board formed on the slide bracket;

the bias element is a spring and is mounted between the abutment board of the slide bracket and the front end of the shaft.

3. The correction tape dispenser as claimed in claim 2, wherein:

the slide bracket further has an extension tab formed on and extending backward from the abutment board and a clasp formed on the extension tab and hooking on and holding the cylinder; and the shaft is hollow and tubular and is mounted slidably and rotatably around the extension tab and the spring of the extending-and-retracting mechanism is mounted around the extension tab.

4. The correction tape dispenser as claimed in claim 2, wherein the slide bracket further has a protrusion formed on and extending backward from the abutment board and mounted in the bias element.

5. The correction tape dispenser as claimed in claim 1, wherein the bias element is a recoiling tab mounted to the front end of the shaft and having a front end pressing against the abutment board of the slide bracket.

6. The correction tape dispenser as claimed in claim 1, the core assembly has a mounting recess defined in the front end of the core assembly and having an inner surface; and a connector mounted on the head, mounted in the mounting recess, being resilient, being capable of twisting to rotate the head and having a limit formed on and extending transversely from the connector in the mounting recess, tapered outward and selectively pressing against the inner surface of the mounting recess.

7. The correction tape dispenser as claimed in claim 6, wherein:

the rear end of the rear cover further a rear opening communicating with the chamber; and a press button is mounted slidably through the rear opening in the chamber and abuts the rear end of the cylinder of the extending-and-retracting mechanism.

8. The correction tape dispenser as claimed in claim 6, wherein:

the core assembly further has a shoulder; and the slide bracket further has a front end, a rear end, a pairs of rear hooks formed on the rear end of the slide bracket, hooking on the spring and hooking on the press button, an abutment board formed on the slide bracket and a front hook formed on the front end of the slide bracket and hooking on the shoulder.

9. The correction tape dispenser as claimed in claim 7, wherein:

the front cover further has a locking slot defined in the bottom of the front cover, two rail recesses defined in the cavity respectively on the sides and a locking hole defined through one of the sides; and the rear cover further has a bottom locking hook formed on the front end and hooking in the locking slot in the front cover and a strip formed on and extending forward from the front end of the rear cover, mounted slidably in one of the rail recesses in the front cover and having a recoiling tab formed on the strip and having a distal end and a side locking hook formed on the distal end and hooking in the locking hole.

10. The correction tape dispenser as claimed in claim 1, wherein the cylinder further has multiple alignment projections formed on and extending radially from the cylinder and the grooves in the mounting hole in the rear cover slidably receives the alignment projections respectively.

11. The correction tape dispenser as claimed in claim 1, wherein the front opening in the front cover has a flat upper inner surface, a flat lower inner surface and two curved side inner surfaces.

12. The correction tape dispenser as claimed in claim 1, wherein the core assembly is replaceable, the core of the core assembly has a reel of a correction tape and the head is wound by the correction tape.

* * * * *